US007778116B2

(12) United States Patent
Maeder

(10) Patent No.: US 7,778,116 B2
(45) Date of Patent: Aug. 17, 2010

(54) TIMEPIECE HAVING COMPASS FEATURE

(75) Inventor: Jean-Bernard Maeder, Bienne (CH)

(73) Assignee: Swiss Army Brands, Inc., Shelton, CT (US)

( * ) Notice: Subject to any disclaimer, the term of this patent is extended or adjusted under 35 U.S.C. 154(b) by 96 days.

(21) Appl. No.: 11/390,502

(22) Filed: Mar. 27, 2006

(65) Prior Publication Data

US 2006/0285442 A1 Dec. 21, 2006

Related U.S. Application Data

(60) Provisional application No. 60/665,399, filed on Mar. 25, 2005.

(51) Int. Cl.
*G04B 47/06* (2006.01)

(52) U.S. Cl. ..... 368/14; 368/241

(58) Field of Classification Search ..... 368/12, 368/14, 241

See application file for complete search history.

(56) References Cited

U.S. PATENT DOCUMENTS 4,077,032 A * 2/1978 Volkman ..... 368/29
4,482,255 A * 11/1984 Gygax et al. ..... 368/10
4,668,100 A * 5/1987 Murakami et al. ..... 368/10
5,175,936 A * 1/1993 Sato ..... 33/354
5,600,611 A 2/1997 Kamens
5,697,162 A * 12/1997 Bornand et al. ..... 33/352
5,883,861 A * 3/1999 Moser et al. ..... 368/10
6,662,459 B2 * 12/2003 Kato ..... 33/356
6,791,477 B2 * 9/2004 Sari et al. ..... 340/995.19
2004/0016058 A1 * 1/2004 Gardiner et al. ..... 7/119
2007/0016091 A1 * 1/2007 Butt et al. ..... 600/519

FOREIGN PATENT DOCUMENTS

EP 0 078 510 5/1983
EP 0 682 301 11/1995
EP 1 041 466 10/2000

OTHER PUBLICATIONS

International Search Report; PCT/US2006/011015; Feb. 15, 2007.

* cited by examiner

*Primary Examiner*—Renee S Luebke
*Assistant Examiner*—Sean Kayes
(74) *Attorney, Agent, or Firm*—Cantor Colburn LLP

(57) ABSTRACT

A timepiece, including a compass for indicating north, a directional display, and a controller, where the controller allows a user to select a bearing direction relative to north, and where the directional display provides a first visual indication to the user when the timepiece is aligned with the bearing direction, and a second visual indication when the timepiece deviates from the bearing direction.

3 Claims, 3 Drawing Sheets

TIMEPIECE HAVING COMPASS FEATURE

CROSS REFERENCE TO RELATED APPLICATION

This patent application is related to and claims the benefit of U.S. Provisional Application Ser. No. 60/665,399 filed on Mar. 25, 2005, the entire contents of which are incorporated herein by reference in their entirety.

TECHNICAL FIELD OF INVENTION

The invention relates generally to a timepiece and, more particularly, to a timepiece, specifically a wristwatch, having an integrated compass feature.

BRIEF DESCRIPTION OF RELATED ART

Compasses have long been used in combination with wristwatch timepieces. See, for example, Swiss Patent Nos. 346,826 and 324,565 and U.S. Pat. Nos. 5,883,861 and 5,790,477. However, these earlier attempts at combining the directional features of a compass with a timepiece invariably resulted in a cumbersome arrangement having an oversized timepiece housing and/or raised features on a face of the housing. These deficiencies complicate manufacture of the timepiece and result in an arrangement which is awkward to wear and use. Moreover, these earlier attempts only provide the simple functions of indicating magnetic north and/or of allowing the user to determine the azimuth direction of a predetermined axis relative to magnetic north. None of these earlier references provide a simple means to assist a user in choosing a specific direction and in maintaining that chosen direction during forward movement.

Therefore, a timepiece is desired which provides a compass feature in an integrated, compact arrangement which is convenient to wear, simple to use, and which assists the user in designating a specific direction and in maintaining that specific direction during movement.

BRIEF SUMMARY OF THE INVENTION

The invention generally provides a timepiece having a compass feature in an integrated, compact arrangement which is convenient to wear, simple to use, and which assists the user in designating a specific direction and in maintaining that specific direction during movement.

More particularly, a timepiece is provided comprising a compass for indicating north, a directional display, and a controller, wherein the controller allows a user to select a bearing direction relative to north and wherein the directional display provides a first visual indication to the user when the timepiece is aligned with the bearing direction and a second visual indication when the timepiece deviates from the bearing direction.

The invention further provides a timepiece comprising a compass for indicating north, a directional display, and a controller, wherein the controller allows a user to select a bearing direction relative to north, wherein the directional display provides a first visual indication to the user when the timepiece is aligned with the bearing direction, a second visual indication when the timepiece deviates from the bearing direction by a first deviation, and a third visual indication when the timepiece deviates from the bearing direction by a second deviation, and wherein the second deviation is greater than the first deviation.

The invention additionally provides a wristwatch comprising a housing, a watch face disposed in the housing, a crystal disposed on the housing over the watch face, a heading display disposed on the watch face and configured to indicate a direction of a reference axis of the timepiece, an actuator configured to set the direction of the reference axis, a visual indicator disposed on the watch face and configured to provide a first visual indication to a user when the reference axis is aligned with the set direction and a second visual indication when the reference axis deviates from the set direction.

The invention also provides a method of maintaining an azimuth heading using a timepiece having a reference axis or point, a heading display, a directional display, and a compass for determining the direction north. The method generally comprises aligning the reference axis or point with a heading, displaying the heading on the heading display, storing the heading in a memory of the timepiece, providing a first visual indication on the directional display when the reference axis or point is aligned with the stored heading, and providing a second visual indication on the directional display when the reference axis or point deviates from the stored heading by a first deviation.

The above discussed and other features and advantages of the present invention will be appreciated and understood by those skilled in the art from the following detailed description and drawings.

BRIEF DESCRIPTION OF THE DRAWINGS

Referring now to the drawings wherein like numerals designate like components.

DETAILED DESCRIPTION OF THE INVENTION

Figure 1:
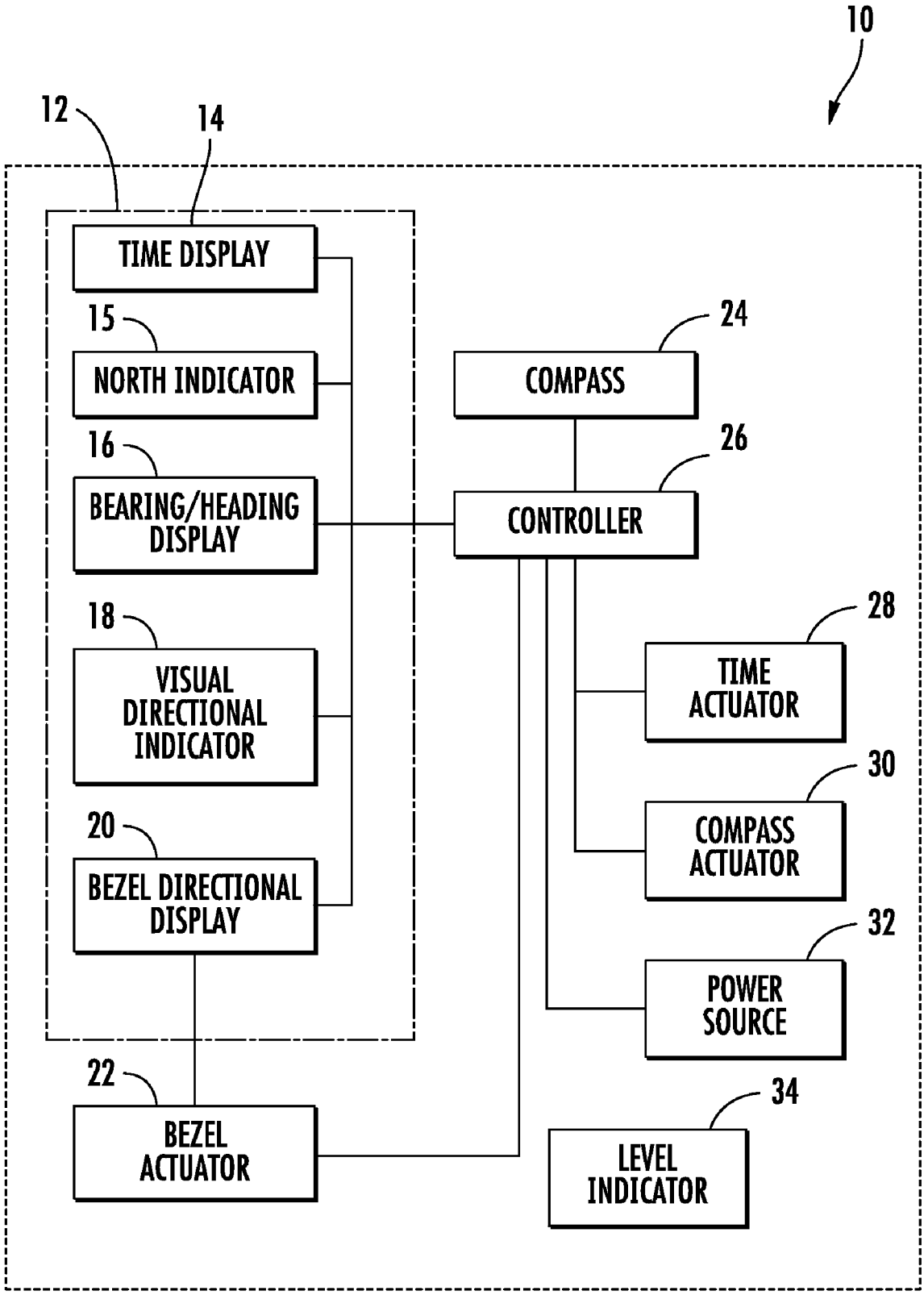
FIG. 1 is a schematic representation of a timepiece in exemplary embodiment of the invention.

FIG. 1 is a schematic representation of a timepiece 10 in one exemplary embodiment of the invention. The timepiece 10 may comprise any portable device or devices configured for tracking and displaying time. Preferably, the timepiece 10 comprises a watch to be worn on the wrist of a user. For sake of convenience, timepiece 10 and wristwatch 10 are herein used interchangeable. However, the broad intent and scope of the timepiece 10 shall be understood as including a wristwatch and any other portable time device.

The wristwatch 10 includes a watch face 12 having a number of displays disposed thereon and/or therein for indicating time, direction, etc. to a user of the wristwatch 10. These displays are now discussed in turn.

A time display 14 is disposed on the face 12 of the wristwatch. The time display 14 is composed of any element or elements suitable for visually indicating time to the user. In a preferred embodiment, the time display 14 includes traditional clock hands which rotate above the watch face 12 to indicate the time. (See, for example, FIGS. 2-3). This time display 14 may further include numerals or symbols on the watch face 12 over which the clock hands pass for designating hours, minutes, etc. Additionally and/or alternatively, the time display 14 may comprise an LCD display or the like for representing the time in the form of characters, such as numbers, letters, or words, or in the form of simulated clock hands, etc.

The face of the wristwatch 10 further includes a north indicator 15 for visually giving indication of magnetic or geographic north, as desired. The north indicator 15 generally comprises any arrangement suitable for indicating the north direction on demand of the user. For example, the north indicator 15 may comprise an LED or LCD arrangement configured to indicate the direction of north by way of one or more symbols, graphics, characters, etc. In a preferred embodiment, the north indicator 15 comprises a series of LEDs disposed in the watch face 12 around a periphery thereof. When required, the LED most proximate to the north and most aligned with the north direction illuminates to indicate such direction.

The face 12 of the wristwatch 10 further includes a bearing/heading display 16 for representing a direction of a reference axis of the watch face 12 and/or a chosen direction selected by the user, as to be discussed further herein. The bearing/heading display 16 shall represent such direction(s) in the form of characters, such as numerals and/or letters, or in the form of symbols, graphics, or any other visual representation suitable for indicating the direction. Preferably, the bearing/heading display 16 comprises an LCD display panel, or the like, which indicates the azimuth in degrees, 0°-360°, where magnetic north is taken as 0°, corresponding to the direction of the axis of the watch face 12 or corresponding to the chosen direction.

The face 12 of the wristwatch 10 further includes a visual directional indicator 18. This item comprises any element disposed on the watch face 12 suitable for visually indicating to the user whether a reference axis of the watch face 12 is aligned with a chosen direction or misaligned with such direction and the extent of misalignment. In one embodiment of the invention, the visual directional indicator 18 comprises a plurality of adjacently disposed LEDs. See, for example, FIGS. 2-3. As discussed further herein, in this arrangement the center LED illuminates when the reference axis of the watch face 12 is aligned with the chosen direction and the outer LEDs illuminate when the axis is misaligned. The invention contemplates any arrangement of such LEDs suitable for providing the desired directional indication. Further, the visual directional indicator 18 may comprise an LCD display or the like for indicating alignment and misalignment of the reference axis and the chosen direction. For example, such LCD could display "YES" when the reference axis is aligned and "NO" upon misalignment. Alternatively, the LCD could display any such words, letters, symbols, other characters, graphics, etc., to indicate axis alignment and misalignment.

The face 12 of the wristwatch 10 also includes a bezel directional display 20 for visually indicating direction in the form of North, East, South, etc., and/or N, E, S, etc., and/or azimuth numerals, e.g., 15, 30, etc. The bezel directional display 20 is disposed at the bezel portion of the wrist watch 10, i.e., around a periphery of the watch face 12. The bezel directional display 20 may be maneuvered about the watch face 12 by a bezel actuator 22 disposed on the watch 10 in working engagement with the display 20. For example, the bezel actuator 22 may comprise a rotatable knob which, when rotated by the user, mechanically maneuvers the bezel directional display 20. Alternatively, the bezel actuator 22 may comprise a button or the like which serves as a switch which, when pressed by the user, activates an electronic circuit or servomotor or the like which powers an automatic movement of the bezel directional display 22. Of course, the bezel directional display 22 may comprise a display, such as an LCD display, disposed fixedly around the periphery of the watch face 12. In such embodiment, pressing the bezel actuator 22 would cause the LCD display to indicate the relevant North, East, South, etc., and/or N, E, S, etc., and/or azimuth numerals, e.g., 15, 30, etc., as discussed further herein.

The wristwatch 10 further includes a compass 24 for detecting magnetic or geographic north, as desired. The compass 24 is preferably disposed within a housing of the wristwatch 10 and may comprise any suitable compass arrangement such as an electronic compass, a magnetic compass, an electromagnetic compass, etc.

The wristwatch 10 also includes a controller 26 disposed within the housing. Generally, the controller 26 comprises one or more units configured to facilitate the time and compass operations of the watch 10, as will be discussed in detail further herein. More particularly, the controller 26 comprises an element or elements disposed to operate the various displays and indicators of the watch face 12. Also, the controller 26 is disposed communicatively with the compass 24 and is configured to receive and process directional information from the compass 24 and to transmit such information to the various displays and indicators of the watch face 12. The controller 26 may include a microchip to facilitate required processing. For example, the controller 26 may include the HCM 6352 and/or HMC 1052 commercially made commercially available by Honeywell International Inc. The controller 26, of course, may include additional chips and/or drivers and/or other known devices, microdevices, circuitry, memories, processors, etc., to facilitate and support the time and/or compass operations of the watch 10.

The watch 10 further includes time actuator 28 disposed in communication with the processor 26. The time actuator 28 comprises an interface by which the user may set or adjust time features of the watch 10. For example, the time actuator 28 may be a knob or a button on the housing of the watch 10 which may be maneuvered by the user to effect the time display 14 of the watch face 12. The time actuator 28 may be mechanically arranged to effect the time display 14 or the actuator 28 may be electronically configured to provide automatic (non-mechanical) adjustment of the time display 14.

The watch 10 further includes a compass actuator 30 disposed in communication with the processor 26. The compass actuator 30 comprises an interface by which the user may set or adjust compass/directional features of the watch 10. For example, the compass actuator 30 may be a knob or a button on the housing of the watch 10 which may be maneuvered by the user to effect the bearing/heading display 16 of the watch face 12. The compass actuator 30 may be mechanically arranged to effect the display 16 or the actuator 30 may be electronically configured to provide automatic (non-mechanical) adjustment of the display 16.

Of course, the time and compass actuators 28 and 30, respectively, of the watch 10 are shown and described herein in exemplary schematic format; variations and modifications thereof are clearly contemplated by the invention. For example, the time actuator 28 may additionally and/or alternatively be disposed in direct communication with the time display 14. Similarly, the compass actuator 30 may be additionally and/or alternatively be disposed in direct communication with the compass 24 and/or the bearing heading display 16.

The watch 10 includes a power source 32 such as, for example, a battery. The power source 32 provides energy to the controller 26. Other components of the watch 10 may be powered by way of the controller 26 or directly from the power source 32, as desired.

A level indicator 34 is provided on the watch 10 for indicating whether a reference axis of the watch face 12 is positioned horizontally with respect to a ground plane. Preferably, the level indicator 34 is formed as an integral part of the housing of the watch 10. The level indicator 34 may be a traditional level (i.e., a spirit level utilizing an air bubble within a contained liquid), an electronic or digital level, a laser level, etc.

The operation of the watch 10 of FIG. 1 is now discussed.

The time display 14 visually indicates the time as discussed above. The time display 14 and the watch 10 may further be configured to include additional features known in the art such as, for example, date, chronograph, alarm, timer, etc. In known manner, the user can utilize the time actuator 30 to adjust and/or set the various features of the time display 14.

To initiate the compass function of the watch 10, the user places the watch 10 in a horizontal orientation using the level indicator 34 and then toggles (i.e., pushes, turns, etc.) the compass actuator 30 to place the watch in a compass mode. Once in this compass mode, the compass 24 and the controller 26 determine the north direction and indicate such direction via the north indicator 15. Simultaneously, the bearing/heading display 16 indicates the azimuthal bearing of a reference axis of the watch face 12. The bearing/heading display 16 varies the azimuthal bearing as appropriate as the user maneuvers the watch about a vertical axis, i.e., as the user turns the watch 10 and as the reference axis rotates through various azimuths. When a desired bearing azimuth is displayed on the bearing/heading display 16, the user may again toggle the compass actuator 30 to set the bearing. Once set, the chosen bearing is saved in a memory of the controller 26 and is displayed on the bearing/heading display 16. Now the user is able to proceed in the direction of the chosen bearing. The watch 10 is maintained generally in the horizontal position during movement in the direction of the bearing. Using the compass 24, the controller 26 calculates position of the reference axis of the watch face 12. When the reference axis is substantially aligned with the chosen bearing, the controller 26 initiates the visual directional indicator 18 to indicate that the chosen bearing is being correctly followed. If the reference axis is maneuvered by the user into misalignment with the chosen bearing, the controller initiates the visual directional indicator 18 to indicate that the chosen bearing is not being followed. The user may exit this compass mode by toggling once more the compass actuator 30. If desired, when the north direction is indicated the bezel actuator 22 may be used to align the N, S, E, directional indicators of the bezel directional display with north as indicated by the north indicator 16.

While the watch 10 is in a sleep mode, an approximately three second long push-and-hold of the compass actuator 30 starts a declination setting display which shows on the bearing/heading display 16 different declination number choices as the watch is turned. The numbers displayed go from 0 to 90E (which means 90 degrees East), and to 90L (which means 90 degrees West). The watch 10 will stay in this mode until the button is pressed again to accept a declination. The visual directional indicator 18 flashes dimly to indicate to the user that the watch 10 is waiting for a button press to leave this mode. After a quick press, the visual directional indicator 18 strobe from left to right twice to show acceptance of declination. Then the watch 10 returns to sleep. In this process, the user turns the compass actuator 30 until the displayed declination matches a chosen declination.

While the watch 10 is in sleep mode, an eight second long push-and-hold of the compass actuator 30 starts a compass calibration mode which lasts 24 seconds. This mode starts by rapidly illuminating the north indicator 15 to show that calibration has started. Then, each north indicator 15 (which, in this embodiment, are arranged around a periphery of the watch face 12) illuminates once per second around the watch face 12 in sequence to show the rate that the watch should be rotated. The watch 10 is then rotated to establish calibration. After 24 seconds, the watch 10 then returns to sleep.

Of course, the time periods associated with setting the declination and calibration are provided herein by way of example only. Any desired time periods may be employed so long as the user can readily distinguish between the various periods sufficient to actuate the watch 10.

Figure 2:
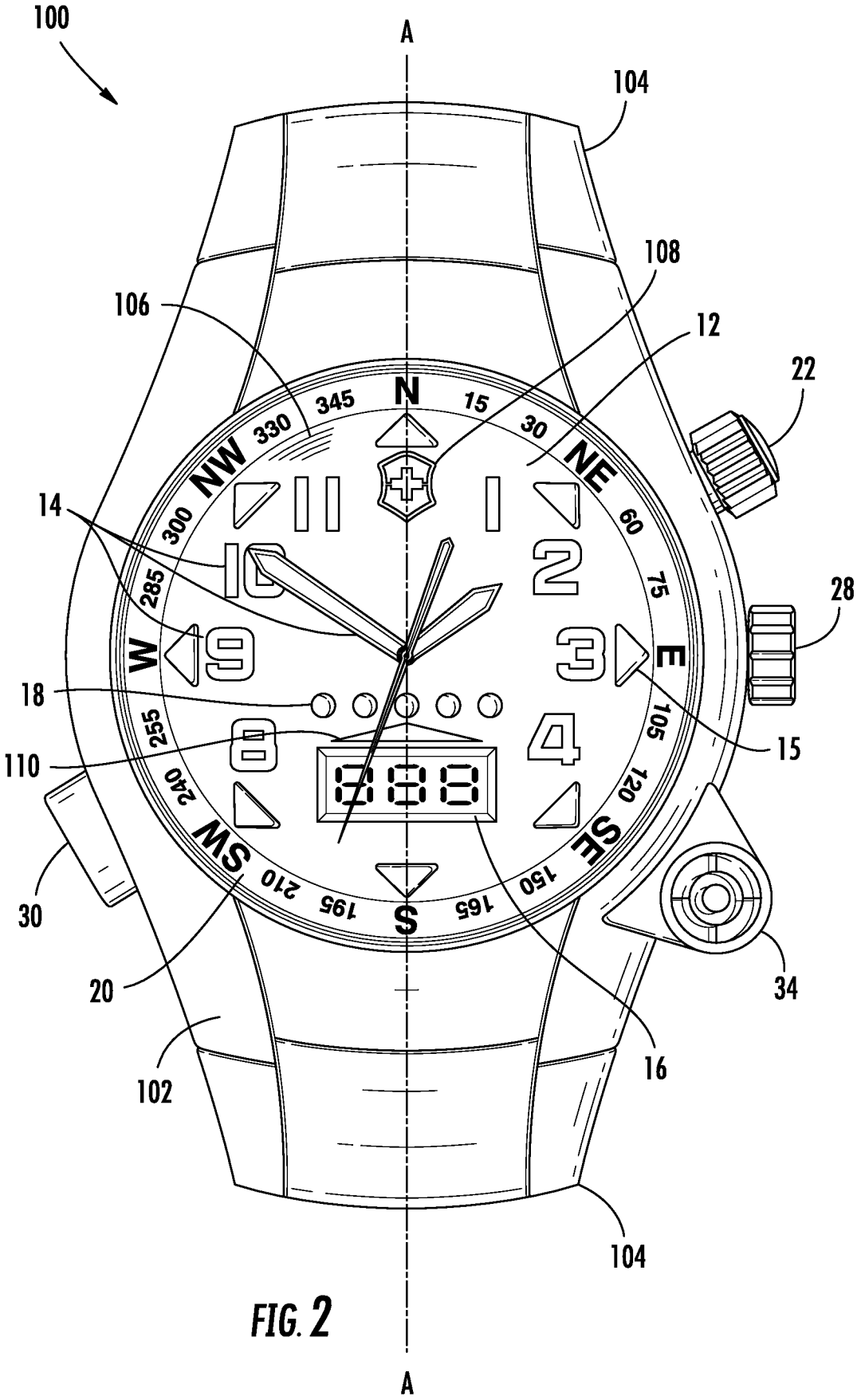
FIG. 2 is a plan view of a timepiece in an exemplary embodiment of the invention.
Figure 3:
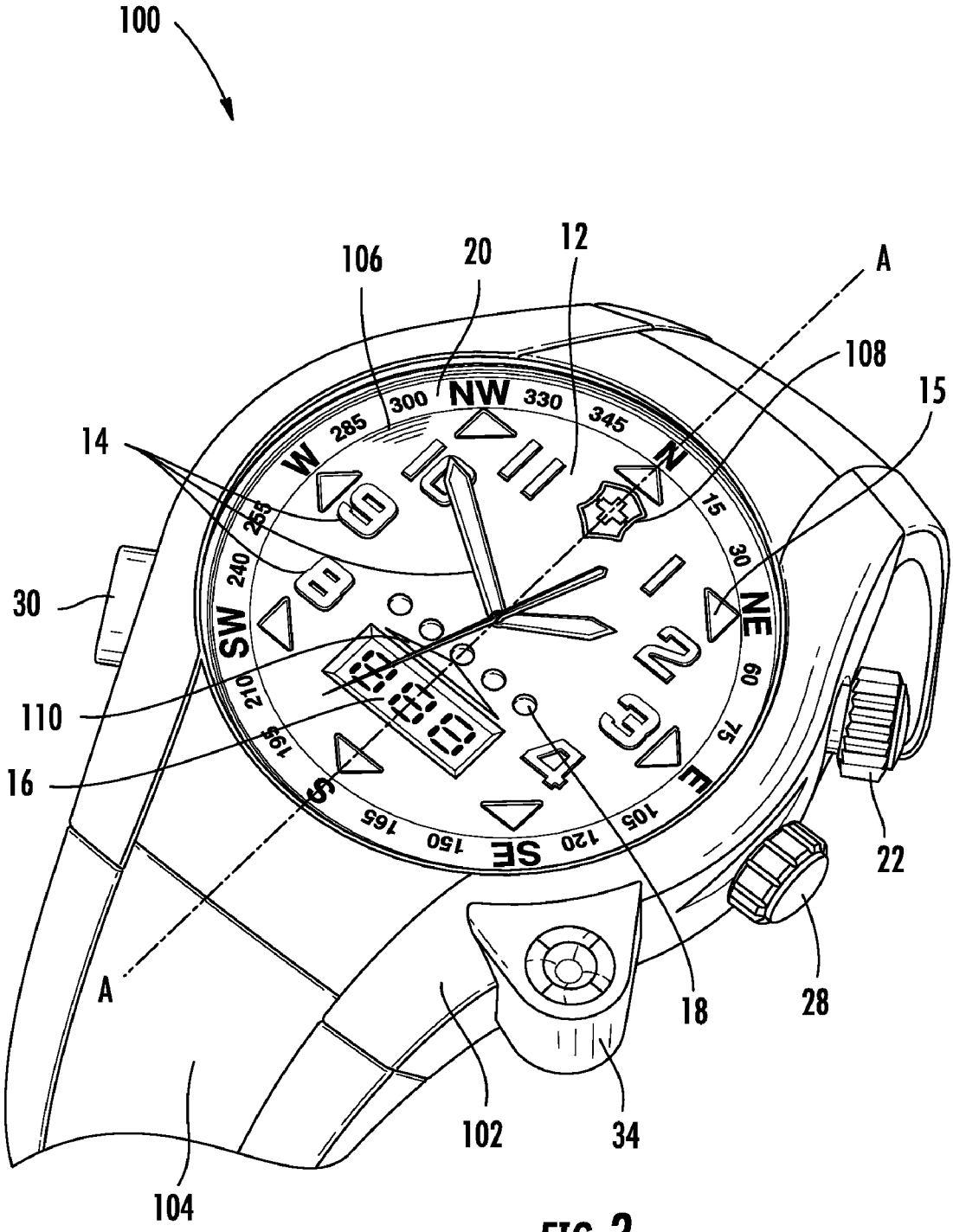
FIG. 3 is perspective view thereof.

FIGS. 2 and 3 show a wristwatch 100 in a preferred embodiment of the invention. The watch 100 includes many features previously described with respect to the schematically represented watch 10. These common features are indicated in FIGS. 2-3 with consistent reference numbers and, for sake of brevity, are not re-introduced in detail with respect to FIGS. 2 and 3.

The wristwatch 100 includes a housing 102 and a strap 104 attached thereto. The housing 102 contains the watch face 12 disposed beneath a crystal 106. The watch face 12 includes the time display 14 here shown as traditional clock hands (hour, minute, second). The time display 14 also includes numerals 1, 2, 3, 4, 8, 9, 10, and 11. The time display 14 may further include numeral 12 disposed between numerals 11 and 1 and/or numeral 6 disposed between numerals 4 and 8, as desired. In the watch 100, the north indicators 15 are triangular elements spaced evenly about the periphery of the watch face 12. The triangular north indicators are selectively illuminated by LEDs disposed within the housing 102 in order to indicate the direction north, as discussed herein. The bearing/heading display 16 of the watch 100 comprises an LCD display disposed in the watch face 12 and configured to represent three numerals in order to indicate the bearing/heading. Just above the LCD bearing/heading display 16, the face 12 of the watch 100 includes the visual directional indicator 18. Here, this indicator 18 comprises five aligned circles which are selectively illuminated by LEDs disposed within the housing 102. Preferably, the center circle is illuminated by a green LED, the circles to the immediate right and left of the center circle are illuminated by yellow LEDs, and the outermost circles are illuminated by red LEDs.

The north indicators 15 and the visual directional indicator 18 are herein described by way of example only. The north indicators 15 generally comprise any feature or features which provide a visual indication of magnetic or geographic north when desired by the user of the watch. The described LEDs of the north indicators 15 may vary in shape, configuration, number, size, etc. For example, the north indicators 15 of the wristwatch 100 may include more or less triangular LEDs, they may be differently shaped, the watch 100 may include an LED band concentric with the bezel display 20 configured to indicate the direction north at any point along the LED band, etc. Similarly, the five green, yellow, and red LEDs described with reference to the directional indicator 18 are provided by way of example only. The indicator 18 generally comprises any feature or features configured to visually indicate to the user of the watch 100 when the axis A-A is aligned with and not aligned with chosen azimuth. For example, the indicator 18 may include more or less circular LEDs, the LEDs may be of a different shape, different color LEDs may be used, a single elongated LED band may be used, etc. Additionally, LEDs are described illustratively with respect to the indicators 15 and 18. The indicators may use any other suitable means of providing the desired visual indications.

The bezel directional display 20 of the watch 100 comprises a thin rotating element movably disposed at the periphery of the watch face 12. Here, the bezel directional display 20 includes directional indicia (N, NE, E, etc.) and azimuth bearing numerals (15, 30, 60, etc.). The bezel directional display 20 may be rotated about the watch face 12 by turning of the bezel actuator knob 22. The watch 100 further includes the time actuator 28, in the form of a rotating knob, disposed on the housing 102 proximate to the three o'clock position of the watch face 12. The compass actuator 30 is a push button disposed on the housing 102 proximate to the eight o'clock position of the watch face 12. Finally, the level indicator 34 is integrally formed into the housing 102 of the watch 100 proximate to the four o'clock position of the watch face 12.

Notably, a reference axis A-A of the face 12 of the watch 100 is defined by twelve o'clock and six o'clock positions of the face 12. This axis A-A is further indicated by an emblem 108 and a graphic 10 formed on the face 12 of the watch 100.

The use and operation of the watch 100 is now described.

The watch 100 is worn on the wrist of the user as a typical wrist watch. The clock hands of the time display 14 continues represent present time. The clock hands are adjustable, as desired, by maneuvering of the time actuator 28. If the user desires to utilize the compass and directional features of the watch 100, using the level 34, the face 12 of the watch 100 is positioned horizontally with respect to the ground plane. Then, the compass actuator button 30 is pressed once. This initiates compass mode for approximately ten to fifteen seconds. In this mode, the controller 26, in combination with the compass 24 (not shown in FIGS. 2-3) determines the direction of magnetic north. The controller 26 initiates the LED of the triangular north indicator 15 most proximate to north to blink rapidly to indicate the direction of magnetic north. Simultaneously, the controller 26, in combination with the compass 24, determines the azimuth bearing of the reference axis A-A with respect to the direction of magnetic north. This azimuth bearing (0-360) is displayed on the LCD bearing/heading display 16 of the watch 100. The user maneuvers the watch 100, while maintaining the horizontal orientation thereof, until a desired azimuth bearing is displayed on the LCD 16. When such bearing is attained, the compass actuator button 30 is pressed again and held (e.g., for three to five seconds) to set this bearing as the heading. This azimuth heading is stored in memory until overwritten by a subsequently selected bearing. The chosen heading is shown on the LCD display 16. When the heading is established as such, the five circles of the visual directional indicator 18 provide a visual indication that the heading has been properly stored. For example the circles flash quickly twice, one color at a time from green to yellow to red.

Now, while maintaining the watch generally in the horizontal orientation, the user may proceed in the direction of the stored heading. If the reference axis A-A is maintained in alignment with the chosen heading (+/−five degrees, approximately), the center circle of the visual directional indicator 18 is illuminated green. If the reference axis A-A is maneuvered approximately six to twenty degrees to the left of the chosen heading, then the circle immediately to the left of the center circle is illuminated yellow. If the reference axis A-A is maneuvered approximately six to twenty degrees to the right of the chosen heading, then the circle immediately to the right of the center circle is illuminated yellow. If the reference axis A-A is maneuvered greater than approximately twenty degrees to the left of the chosen heading, then the leftmost outer circle is illuminated red. If the reference axis A-A is maneuvered greater than approximately twenty degrees to the right of the chosen heading, then the rightmost outer circle is illuminated red.

Alternatively, these left/right circle illuminations of the visual directional indicator 18 may be reversed. For example, if the reference axis A-A deviates to the left of the heading, the circles on the right side of the indicator 18 may be illuminated. Vice versa, if the reference axis A-A deviates to the right, the circles on the left of the indicator 18 may be illuminated.

To exit this compass mode of the watch 100, the user may simply press the compass actuator button 30 once quickly. Alternatively, the user may simply allow the time period of the compass mode elapse (e.g., fifteen seconds).

If desired, when the triangular north indicators 15 point in the direction of north, the user may maneuver the bezel directional display 20 via the bezel actuator knob 22 to align the "N" of the display 20 with magnetic north, thus calibrating the bezel display 20 to provide further functionality of the watch 100.

The particulars of the watch 100 are provided herewith for exemplary purposes only. The broad scope of the invention shall be understood as encompassing variations and/or combinations of the descriptions provided herein. For example, the circular visual directional indicators 18 may vary in number, shape, size, and/or disposition on the face 12 of the watch 100 so long as they are suitably configured and disposed for providing the desired indication of alignment, misalignment, and extent of misalignment of the reference axis relative to the chosen heading. Similarly, the triangular north indicators 15 may take any form or disposition advantageous for indicating the direction of north, as discussed herein. Additionally, certain sequences and timings have been described herein with reference to actuating the time and compass actuators 28, 30 in order to operate the watches 10, 100. These sequences and timings are of course exemplary. Any sequence or timing of pressing, turning, switching, etc., (whichever the case may be) of the actuators may be employed.

Notably, the wristwatch described herein does not include any compass features or elements on the top surface of the watch. A compass actuator button and a level indicator are provided at the sides of the watch. However, the watch does not include any cumbersome compass features disposed on or around the crystal covering the watch face or on the housing surrounding the face. All of the compass and directional elements are disposed on or in the watch face or in the housing. Thus, the watch is comfortable and convenient to wear.

Further notably, the watch of the invention enables a user to establish magnetic north and to chose and save a specific bearing direction relative to magnetic north in which to travel. The watch further visually alerts the user when the user is on course with the chosen bearing and when the user deviates from the chosen bearing. Moreover, where the user deviates, the extent of deviation is visually indicated to the user.

Thus, the invention results in a timepiece having a compass feature in an integrated, compact arrangement which is convenient to wear, simple to use, and which assists the user in designating a specific direction and in maintaining that specific direction during movement.

While the invention has been embodied herein as a timepiece and, more particularly, as a wristwatch, the time and compass features described herein may be applied separately or in combination to any portable electronic device such as a personal digital assistant (PDA) device, etc.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best modes contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A wristwatch, comprising:

a housing;

a watch face disposed in the housing;

a crystal disposed on the housing over the watch face;

a heading display disposed on the watch face and configured to indicate a direction of a reference axis of the timepiece;

an actuator configured to set the direction of the reference axis;

a visual indicator disposed on the watch face and configured to provide a first visual indication to a user when the reference axis is aligned with the set direction and a second visual indication when the reference axis deviates from the set direction; and a north display configured to visually indicate the direction of north relative to the reference axis, the north display comprising a plurality of lighting elements disposed on the watch face beneath the crystal proximate to a circumferential edge of the watch face and spaced evenly around the circumferential edge, wherein the lighting elements are configured such that each lighting element emits light when aligned with north.

2. The wristwatch of claim 1, wherein the visual indicator is configured to provide a third visual indication when the reference axis further deviates from the set direction and further comprising a level indicator configured to visually indicate to the user when the reference axis is positioned generally horizontal to a ground plane.

3. The wristwatch of claim 1, wherein the visual indicator comprises a first light emitting diode (LED) arrangement which displays at least one of a color, a numeral, a letter, and a symbol to indicate the first and second visual indications.

* * * * *